US005838762A

United States Patent [19]

Ganin et al.

[11] Patent Number: 5,838,762

[45] Date of Patent: Nov. 17, 1998

[54] ROTATING ANODE FOR X-RAY TUBE USING INTERFERENCE FIT

[75] Inventors: Eti Ganin, Whitefish Bay; Mark O. Derakhshan, West Allis; Thomas G. Ebben, Sullivan, all of Wis.

[73] Assignee: General Electric Company, Milwaukee, Wis.

[21] Appl. No.: 762,013

[22] Filed: Dec. 11, 1996

[51] Int. Cl.[6] ..... H01J 35/10

[52] U.S. Cl. ..... 378/125; 378/131; 378/132

[58] Field of Search ..... 378/119, 127, 378/126, 125, 131, 132, 135, 143, 144

[56] References Cited

U.S. PATENT DOCUMENTS 4,063,124 12/1977 Appelt ..... 378/144
4,635,283 1/1987 Starek et al. ..... 378/125
4,949,368 8/1990 Kubo ..... 378/132

*Primary Examiner*—Don Wong
*Attorney, Agent, or Firm*—B. Joan Haushalter; John H. Pilarski

[57] ABSTRACT

A method for assembling a rotating X-ray tube structure ensures balance retention during the life of the tube. The X-ray tube structure has a cathode for emitting electrons, and a rotor and a bearing assembly for facilitating rotation of an anode. At least one joint is identified in the X-ray tube structure and interference fit assembly is used to eliminate shifts at the joint. The interference fit assembly is particularly advantageous for eliminating even the minutest shifts in the main joints of the anode assembly. Interference fit assembly can be applied between the rotor and the anode target to provide a first joint having balance retention; and interference fit assembly can be applied between the bearing assembly and the rotor to provide a second joint having balance retention.

3 Claims, 3 Drawing Sheets

ROTATING ANODE FOR X-RAY TUBE USING INTERFERENCE FIT

TECHNICAL FIELD

The present invention relates to rotating X-ray tubes and, more particularly, to rotating X-ray tubes which employ a rotating anode assembly having interference fits between its main members.

BACKGROUND ART

The x-ray tube has become essential in medical diagnostic imaging, medical therapy, and various medical testing and material analysis industries. Typical x-ray tubes are built with a rotating anode structure for the purpose of distributing the heat generated at the focal spot. The anode is rotated by an induction motor consisting of a cylindrical rotor built into a cantilevered axle that supports the disc shaped anode target, and an iron stator structure with copper windings that surrounds the elongated neck of the x-ray tube that contains the rotor. The rotor of the rotating anode assembly being driven by the stator which surrounds the rotor of the anode assembly is at anodic potential while the stator is referenced electrically to ground. The X-ray tube cathode provides a focused electron beam which is accelerated across the anode-to-cathode vacuum gap and produces X-rays upon impact with the anode.

In an x-ray tube device with a rotatable anode, the target consists of a disk made of a refractory metal such as tungsten, and the x-rays are generated by making the electron beam collide with this target, while the target is being rotated at high speed. Rotation of the target is achieved by driving the rotor provided on a support shaft extending from the target. Such an arrangement is typical of rotating X-ray tubes and has remained relatively unchanged in concept of operation since its introduction. However, the operating conditions for x-ray tubes have changed considerably in the last two decades.

State-of-the-art X-ray tubes utilize large (200 mm diameter, 4.5 kg) cantilever mounted, targets rotating at speeds as high as 10,000 rpm. Extremely large temperature changes occur during the operation of the tube, ranging from room temperature to temperatures as high as 1600° C., produced by the deceleration of fast electrons in the tungsten-rhenium layer of the target track.

Balance retention at high rotating speeds and high temperatures is extremely crucial. A typical unbalance specification for larger tubes at the time of shipping is 5 g-cm in either the target or rotor planes. Approximately 5% of manufactured tubes with extremely large targets (165 mm diameter, 2.7 kg) are unusable due to high unbalance. A shift of 19 $\mu$m of the target center of gravity will produce this amount of unbalance. As anodes become larger and heavier, the amount of shift that will exceed the unbalance specification becomes less. For the current target size (diameter of approximately 200 mm and mass of approximately 4.5 kg) a shift of 11 $\mu$m will exceed the unbalance specification. These small shifts can easily occur because of the large temperature changes, combined with the use of materials that have different coefficients of thermal expansion. Furthermore, bolted, brazed, and welded joints are a primary source of unbalance.

It would be desirable then to achieve excellent balance retention for a rotating anode of an X-ray tube.

SUMMARY OF THE INVENTION

The present invention provides for excellent balance retention in the anode by using interference fits between its main members, including the target, the bearing assembly, and the rotor assembly.

In accordance with one aspect of the present invention, an anode structure of a rotating X-ray tube is assembled. The X-ray tube has a cathode for emitting electrons, a rotor, and a bearing assembly, the rotor and the bearing assembly facilitating rotation of the anode. The method comprises the steps of providing an anode target which radiates x-ray in response to bombardment by the electrons; using interference fit between the rotor and the anode target to provide a first joint, the first joint having balance retention; and using interference fit between the bearing assembly and the rotor to provide a second joint, the second joint having balance retention.

Accordingly, it is an object of the present invention to provide an anode structure having excellent balance retention at high rotating speeds and high temperatures. It is a further object of the present invention to use interference fits between the main members of the anode structure to prevent members from shifting during tube life.

Other objects and advantages of the invention will be apparent from the following description, the accompanying drawings and the appended claims.

DETAILED DESCRIPTION OF THE PREFERRED EMBODIMENTS

The present invention relates to rotating X-ray tubes which employ a rotating anode assembly and a cathode assembly. The purpose of this invention is to improve the balance retention during tube life.

Figure 1:
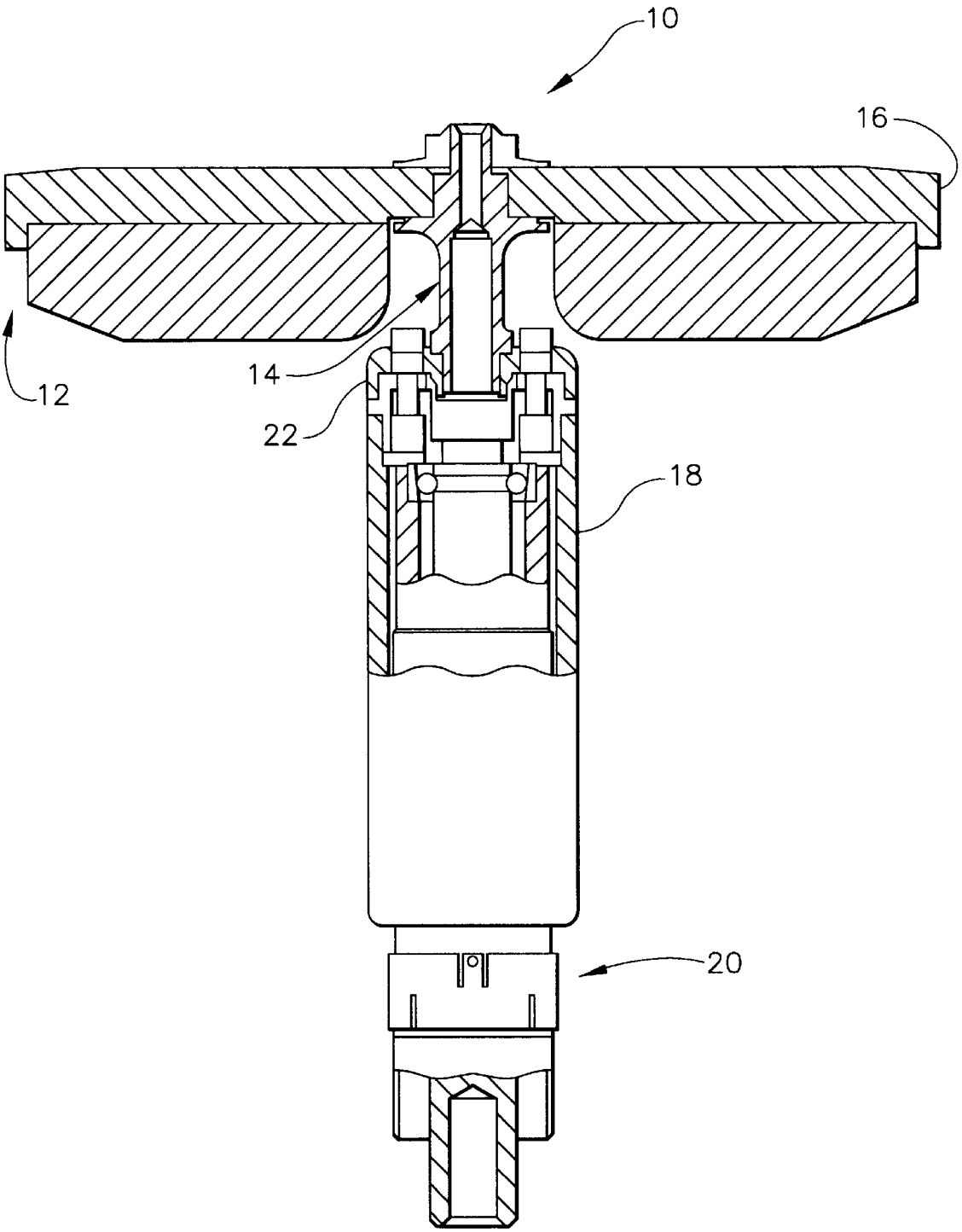
FIG. 1 is a prior art cross-sectional illustration of a typical X-ray tube anode.

Referring now to the drawings, FIG. 1 illustrates a typical prior art X-ray tube anode assembly. The X-ray tube is typically built with a rotating anode assembly 12, with an associated stem 14, for the purpose of distributing the heat generated at a focal spot. The anode assembly 12 comprises a target 16 and a rotor 18, also at anodic potential. A typical X-ray tube further comprises an X-ray tube cathode assembly (not shown) for providing a focused electron beam which is accelerated across a large anode-to-cathode vacuum gap and producing X-rays upon impact with the anode.

Continuing with FIG. 1, the anode assembly 12 is rotated by an induction motor comprising the cylindrical rotor 18 built around a cantilevered axle 20. The cantilevered axle 20 supports the disc shaped anode target 16 connected via a stud and hub 22 to rotor 18 and bearing assembly 20, which contains bearings facilitating rotation. The rotor 18 of the rotating anode assembly 12, driven by a stator of the induction motor, is at anodic potential while the stator is referenced electrically to ground.

In a typical assembly, the target 16, rotor assembly 18, and bearing assembly 20 are assembled using bolted, brazed and/or welded joints. The present invention provides for a significant improvement in the fit between the main members of the anode assembly 12.

Figure 2:
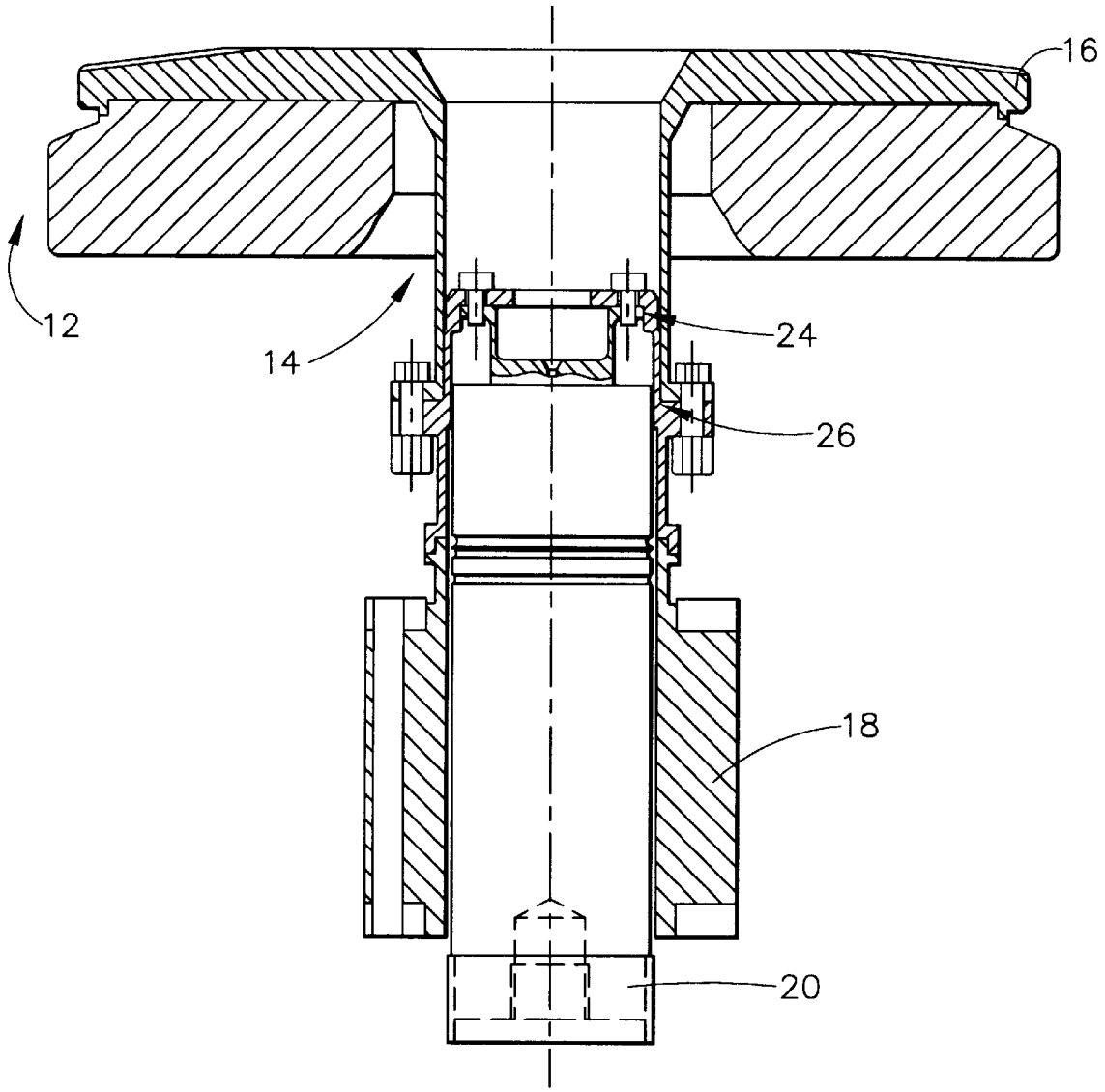
FIG. 2 is a cross-sectional view of an anode incorporating the interference fit construction of the present invention.
Figure 3:
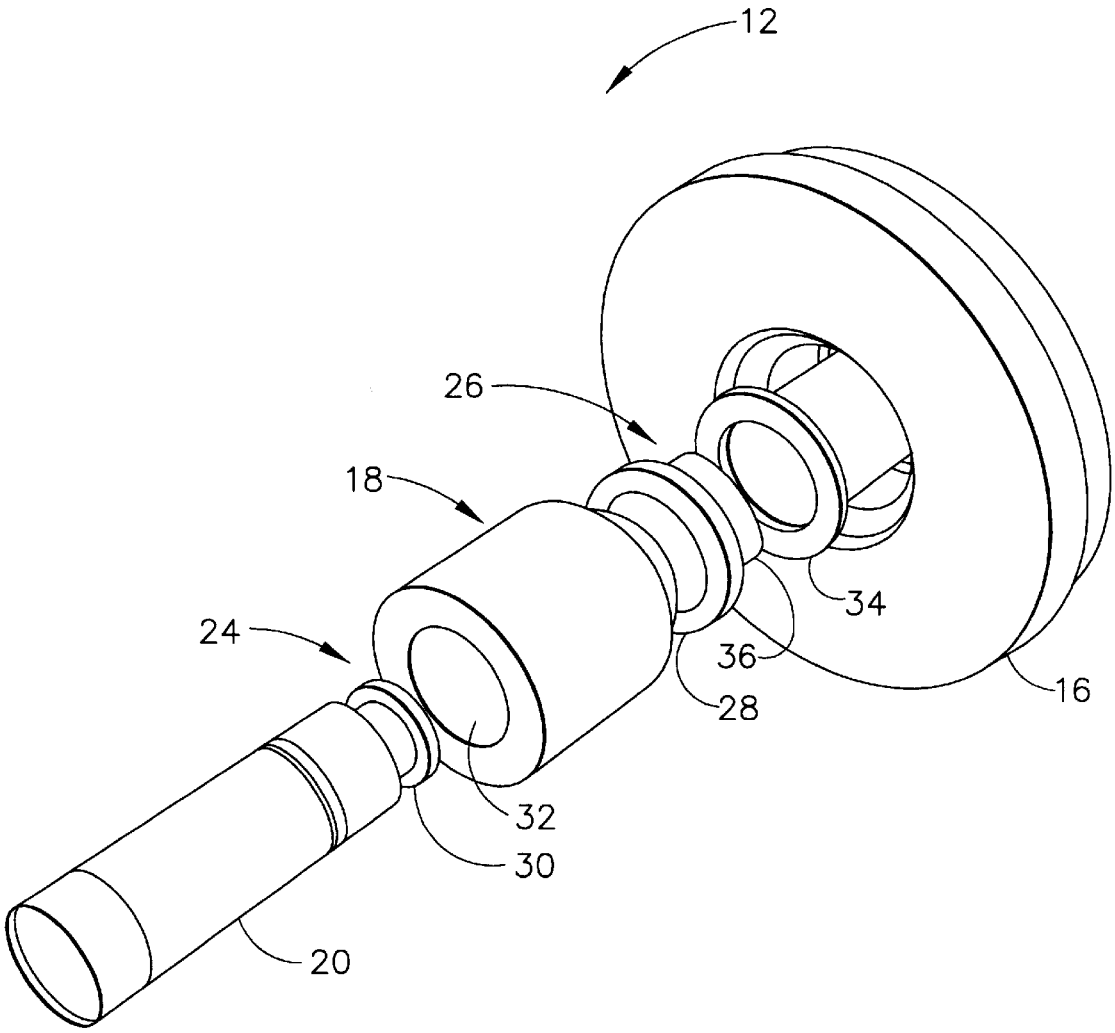
FIG. 3 is an exploded perspective view of the anode structure of FIG. 2, illustrating the interference fit construction in accordance with the present invention.

Continuing with FIG. 1 and referring also to FIGS. 2 and 3, the present invention proposes using interference fit assembly in the X-ray tube anode assembly, to eliminate shifting of components at the joints. The concept of interference fit assembly is particularly adaptable for use with the anode assembly 12. The anode assembly 12, as best illustrated in FIG. 2, is comprised of three main members, including the target 16, the bearing assembly 20, and the rotor assembly 18. Furthermore, the anode assembly 12 comprises two main joints, including a bearing-to-rotor joint at location 24 and a target-to-rotor joint at location 26. Application of interference fit assembly at these main joints, in accordance with the present invention, ensures balance retention during the life of the tube by eliminating any shifts in these main joints. In a preferred embodiment of the present invention, then, the target 16, bearing assembly 20, and rotor assembly 18 are machined to interference fit tolerances, to achieve fully concentric joints. The interference fit parts can then be assembled using any suitable means such as radio-frequency (RF) heating.

By way of example only, and not to be considered as limiting the scope of the invention, interference fit assembly of an anode structure is described. Referring to FIG. 3, first, thermal barrier portion 28 of rotor assembly 18 is subjected to an assembly step, such as RF heating. This allows for joint end 30 of bearing assembly 20 to be received into receiving aperture 32 of rotor assembly 18. When the bearing assembly 20 is positioned, the application of heat stops and the joint at location 24 is allowed to cool. Next, target flange 34 of target 16 is subjected to an assembly step, again RF heating. End 36 of thermal barrier 28 to the rotor assembly 18 can then be received by the target flange 34. Once the rotor assembly 18 is properly positioned relative to the target 16, the joint at location 26 is allowed to cool. This results in an anode assembly 12 having ensured balance retention during the life of the tube by eliminating even the minutest shifts in the main joints. Obviously, however, any combination of joints and/or parts of the tube can be interference fit to achieve the concentricity desired.

Although the invention has been described relative to interference fit assembly of an anode structure, it will be obvious to those skilled in the art that concept of the present invention, interference fit assembly in the X-ray tube environment, is applicable to all aspects of X-ray tube assembly. It will further be obvious to those skilled in the art that various modifications and variations of the present invention are possible without departing from the scope of the invention, which applies interference fit assembly in the X-ray tube environment to prevent tube components from shifting during tube life. For example, the heating of the components of the joints and the mechanical assembly process could be performed in any of a variety of suitable ways, including changing the actual order of assembly, without departing from the scope of the invention.

The invention has been described in detail with particular reference to certain preferred embodiments thereof, but it will be understood that modifications and variations can be effected within the spirit and scope of the invention, defined by the claims.

We claim:

1. A method for assembling a rotating X-ray tube structure, the X-ray tube structure having a cathode for emitting electrons, and a rotor and a bearing assembly for facilitating rotation of an anode, the method comprising the steps of:

identifying at least one joint in the X-ray tube structure;

using interference fit assembly to eliminate shifts at the at least one joint;

wherein the step of using interference fit assembly further comprises the step of:

using interference fit assembly between the rotor and the anode target to provide a first joint, the first joint having balance retention; and using interference fit assembly between the bearing assembly and the rotor to provide a second joint the second joint having balance retention.

2. A method for assembling a rotating X-ray tube structure as claimed in claim 1 further comprising the step of providing an anode target which radiates x-ray in response to bombardment by the electrons.

3. A method for assembling a rotating X-ray tube structure as claimed in claim 1 further comprising the step of applying heat to the at least one joint to facilitate positioning of components of the X-ray tube.

* * * * *